US006745708B2

(12) United States Patent
Slater et al.

(10) Patent No.: US 6,745,708 B2
(45) Date of Patent: Jun. 8, 2004

(54) METHOD AND APPARATUS FOR IMPROVING THE EFFICIENCY OF A COMBUSTION DEVICE

(75) Inventors: Peter N. Slater, Bartlesville, OK (US); Jimmie Joe Straw, Bartlesville, OK (US); Bruce W. Gerhold, Bartlesville, OK (US); Ricky E. Snelling, Tulsa, OK (US); Steven A. Owen, Kingwood, TX (US); Kent E. Jeffers, Sugar Land, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 10/025,339

(22) Filed: Dec. 19, 2001

(65) Prior Publication Data

US 2003/0110993 A1 Jun. 19, 2003

(51) Int. Cl.[7] ..... F23N 5/18; F23L 7/00

(52) U.S. Cl. ..... 110/348; 110/188; 110/297; 431/76

(58) Field of Search ..... 431/75 FA, 76 FA, 431/10, 8, 281, 278; 110/185, 186, 187, 188, 348, 297

(56) References Cited

U.S. PATENT DOCUMENTS

| | | | | | |
|---|---|---|---|---|---|
| 3,388,862 | A | * | 6/1968 | Gabrielson | 236/15 |
| 3,622,257 | A | * | 3/1970 | Hein | 431/51 |
| 4,474,121 | A | * | 10/1984 | Lewis | 110/346 |
| 4,490,108 | A | | 12/1984 | Petzi | 432/23 |
| 4,496,316 | A | | 1/1985 | Tsai | 432/30 |
| 4,870,910 | A | * | 10/1989 | Wright et al. | 110/190 |
| 4,920,998 | A | * | 5/1990 | Deitrick et al. | 137/3 |
| 5,013,236 | A | * | 5/1991 | Khinkis | 431/10 |
| 5,520,123 | A | * | 5/1996 | Chappell et al. | 110/188 |
| 5,630,714 | A | * | 5/1997 | Yuino et al. | 432/36 |
| 5,683,238 | A | * | 11/1997 | Snyder | 431/8 |
| 5,777,241 | A | | 7/1998 | Evenson | 73/863.11 |
| 5,823,764 | A | * | 10/1998 | Alberti et al. | 431/184 |
| 5,931,652 | A | * | 8/1999 | Epworth | 431/3 |
| 6,077,068 | A | * | 6/2000 | Okumura | 431/1 |

FOREIGN PATENT DOCUMENTS

| | | | | |
|---|---|---|---|---|
| DE | 4206377 A1 | * | 9/1993 | F23N/5/18 |
| JP | 57-90522 A | * | 5/1982 | F23N/5/24 |

* cited by examiner

*Primary Examiner*—Ira S. Lazarus
*Assistant Examiner*—Kenneth B. Rinehart
(74) *Attorney, Agent, or Firm*—Bronwyn A. Welvaert

(57) ABSTRACT

A method and/or apparatus for efficiently operating a combustion device including at least one control zone, with each control zone including at least one burner assembly, is disclosed and includes a) individually supplying fuel to each of the burner assemblies in each of the control zones, b) individually measuring a separate combustion characteristic of the collective combusted gas from each of the burner assemblies in each of the control zones, and c) individually adjusting the flow of air to each of the burner assemblies in response to the value of the combustion characteristic corresponding to each of the control zones to keep the value of each separate combustion characteristic within a predetermined range. In a preferred embodiment, primary air and secondary air are separately supplied and controlled to each of the burner assemblies in each of the control zones in response to the value of the combustion characteristic corresponding to each of the control zones.

25 Claims, 3 Drawing Sheets

METHOD AND APPARATUS FOR IMPROVING THE EFFICIENCY OF A COMBUSTION DEVICE

The present invention relates to improving the efficiency of a combustion device by optimizing the concentration or amount of a combustion characteristic in the combusted gas. In another aspect, the invention relates to a method and apparatus for improving the efficiency of a combustion device by adjusting the flow of air to burners contained in the combustion device in response to a measured combustion characteristic of the combusted gas.

BACKGROUND OF THE INVENTION

Combustion devices such as furnaces, boilers, ovens, or stoves are devices in which heat energy is transferred to a charge or feed in a controlled manner. The typical combustion device takes the form of a metal housing lined with heat-conserving refractory. The charge or feed can enter as a solid, liquid or gas and may or may not be transformed to a different state. The charge or feed can be carried through the combustion device continuously through metal tubes or troughs or may be batch-heated. The functions of combustion devices include, but are not limited to, 1) heating or vaporizing the charge; 2) providing heat of reaction to reacting feeds (such as in a cracking reaction) and 3) providing an elevated and controlled temperature for the physical change of charge materials.

An example of a combustion device is a hydrocarbon cracking furnace which transfers heat in a controlled manner to a hydrocarbon, such as ethane, propane or butane, for conversion to olefins. The typical air flow burner adjustment method for such furnaces is based on furnace draft measurements, flame appearance and volume percent oxygen in the stack outlet gas. This procedure can lead to inefficient furnace operation wherein the oxygen level in the stack outlet gas is low, but the heat used for high economic value processes is also low. This can occur if significant fuel combustion and heat transfer occurs in the secondary heat recovery section, higher in the furnace (nearer the stack) and not in the lower section of the furnace where the highest economic value can be realized from the heat transferred to the charge materials.

Thus, it would be clearly desirable to provide a method and/or apparatus for controlling the operation of a combustion device which results in more efficient operation of the combustion device through maximizing heat transfer to charge materials.

SUMMARY OF THE INVENTION

It is an object of the present invention to provide a method of optimizing the efficiency of a combustion device.

A further object of this invention is to provide an apparatus to be used for optimizing the efficiency of a combustion device.

It is yet another object of this invention to provide a method and/or apparatus for optimizing the efficiency of a furnace by maintaining the concentration of a combustion characteristic of the combusted gas, from at least one burner assembly contained therein, within a predetermined range by adjusting the flow of air to at least one burner assembly in response to measured combustion characteristic concentrations.

According to a first embodiment of the present invention, a method of optimizing the efficiency of a combustion device comprising at least one control zone, with each control zone comprising at least one burner assembly, is provided and comprises the steps of:

a) individually supplying fuel to each of the burner assemblies in each of the control zones;

b) individually measuring a combustion characteristic of the collective combusted gas from the burner assemblies in each of the control zones; and c) individually adjusting the flow of air to each of the burner assemblies in each of the control zones in response to the value of the combustion characteristic corresponding to each of the control zones to keep the value of each of the combustion characteristics within a predetermined range.

According to a second embodiment of the present invention, a method of optimizing the efficiency of a combustion device comprising at least one control zone, with each control zone comprising at least one burner assembly, is provided and includes the steps of:

a) individually supplying fuel to each of the burner assemblies in each of the control zones;

b) individually supplying primary air to each of the burner assemblies in each of the control zones for mixture and at least partial combustion with the fuel supplied thereto thereby producing a separate intermediate combustion product for each of the burner assemblies;

c) individually supplying secondary air to each of the burner assemblies in each of the control zones for mixture with the intermediate combustion product for further combustion thereby producing a combusted gas stream for each of the plurality of burner assemblies;

d) individually measuring a combustion characteristic of the collective combusted gas from the burner assemblies in each of the control zones; and e) individually adjusting the flow of primary air and individually adjusting the flow of secondary air to each of the burner assemblies in each of the control zones in response to the value of the combustion characteristic corresponding to each of the control zones to keep the value of each of the combustion characteristics within a predetermined range.

According to a third embodiment of the present invention, a combustion device is provided comprising:

a) at least one control zone comprising at least one burner assembly;

b) at least one gas analyzer operably related to each of the control zones for receiving and analyzing samples of combusted gas from the control zones;

c) each of the burner assemblies comprising:

i) a fuel introduction means for introducing fuel into the burner assembly;

ii) a primary air introduction means for introducing primary air into the burner assembly for mixture and at least partial combustion with the fuel, thereby producing an intermediate combustion product; and iii) a secondary air introduction means for introducing secondary air into the burner assembly for mixture and further combustion with the intermediate combustion product, thereby producing a combusted gas stream for each of the burner assemblies; and d) control means operably related to the primary air introduction means, the secondary air introduction means, and the at least one gas analyzer, for adjusting the flow of primary air and the flow of secondary air to each of the burner assemblies in each of the control zones through the primary air introduction means and the secondary air introduction means, respectively, in response to the value of a combustion characteristic measured in the collective combusted gas streams corresponding to each of the control zones.

Other objects and advantages will become apparent from the detailed description and the appended claims.

DETAILED DESCRIPTION OF THE INVENTION

Figure 1:
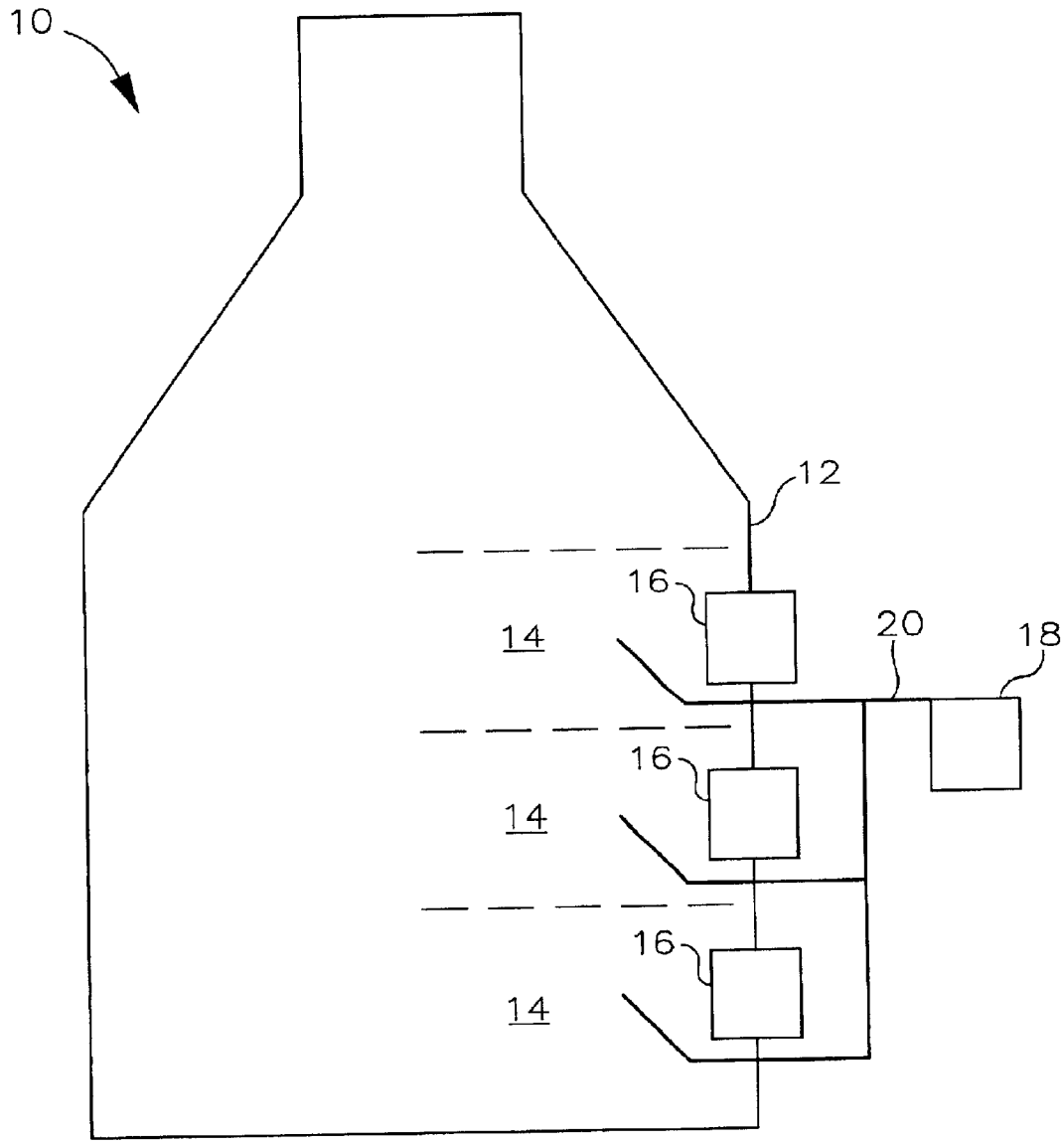
FIG. 1 is a schematic diagram of a combustion device constructed in accordance with the present invention.

Combustion devices suitable for optimization in the present invention include, but are not limited to, a furnace, a boiler, an oven, or a stove.

In accordance with the first embodiment of the present invention, a method of optimizing the efficiency of a combustion device comprising at least one control zone, with each control zone comprising at least one burner assembly, comprises, consists of, or consists essentially of the following.

Individually supplying fuel to each of the burner assemblies. The fuel can be any fuel suitable for supplying heat to a furnace upon combustion, including liquid and gaseous fuels. Most typically, the fuel is a gaseous hydrocarbon such as, but not limited to, natural gas or hydrogen, or the like, and combinations of such fuels. The fuel is burned, in the presence of air, to form combusted gas corresponding to each of the burner assemblies. A separate combustion characteristic of the collective combusted gas from the burner assemblies in each of the control zones is individually measured for each control zone. The measurement is made by any suitable method capable of measuring the combustion characteristic, and is most preferably measured using a gas analyzer, which can include, but is not limited to include, an electrolytic cell and/or a non-dispersive infrared (NDIR) analyzer. The flow of air to each of the burner assemblies in each of the control zones is individually adjusted in response to the value of the combustion characteristic corresponding to each of the control zones to keep the value of each separate combustion characteristic within a predetermined range.

The combustion characteristic can comprise, consist of, or consist essentially of a component selected from the group consisting of oxygen concentration, carbon monoxide concentration, carbon dioxide concentration, and combinations thereof.

The predetermined range for the combustion characteristic, when it is oxygen concentration, is in the range of from about 0.5 to about 5.0 volume %, preferably from about 1.0 to about 3.0 volume %, and most preferably from 1.5 to 2.0 volume %, based on the total volume of the collective combusted gas for each of the control zones.

The predetermined range for the combustion characteristic, when it is carbon monoxide concentration, is preferably less than about 1000 ppmv, more preferably less than about 500 ppmv, and most preferably substantially 0 ppmv, based on the total volume of the collective combusted gas for each of the control zones.

The predetermined range for the combustion characteristic, when it is carbon dioxide concentration, is preferably greater than about 2.0 volume %, more preferably greater than about 5.0 volume %, and most preferably greater than 10.0 volume %, based on the total volume of the collective combusted gas for each of the control zones.

In accordance with the second embodiment of the present invention, a method of optimizing the efficiency of a combustion device comprising at least one control zone, with each of the control zones comprising at least one burner assembly, includes the following.

Fuel, such as the fuel described above, is individually supplied to each of the burner assemblies in each of the control zones. Primary air is individually supplied to each of the burner assemblies in each of the control zones for mixture and at least partial combustion with the fuel supplied thereto, thereby producing a separate intermediate combustion product for each of the burner assemblies. The intermediate combustion product can contain non-combusted fuel or partially combusted fuel.

Secondary air can also be individually supplied to each of the burner assemblies in each of the control zones for mixture with the intermediate combustion product for further combustion with any non-combusted fuel contained in the intermediate combustion product, thereby producing a combusted gas stream for each of the burner assemblies. The combusted gas stream generally contains substantially less non-combusted fuel as compared to the fuel stream, and is preferably substantially free of non-combusted fuel.

A combustion characteristic, as described above, of the combusted gas is individually measured for the collective combusted gas from the burner assemblies in each of the control zones. The flow of primary air and the flow of secondary air to each of the burner assemblies in each of the control zones is individually adjusted in response to the value of the combustion characteristic corresponding to each of the control zones in order to keep the value of each separate combustion characteristic within the predetermined ranges set out above in the first embodiment.

Preferably, the flow of primary air to each of the burner assemblies is adjusted in response to the value of the combustion characteristic corresponding to each of the control zones first, followed by adjustment of the flow of secondary air, as needed, in order to keep the value of each combustion characteristic within the above described predetermined range.

In accordance with the third embodiment of the present invention, and referring to FIG. 1, therein is illustrated combustion device 10 having an inside wall 12 and including at least one control zone 14. Each of the control zones 14 contain at least one burner assembly 16 disposed along the length of inside wall 12. The combustion device 10 also includes at least one gas analyzer 18 having at least one probe 20 operably related to the control zones 14 for receiving and analyzing samples of combusted gas from control zones 14.

Figure 2:
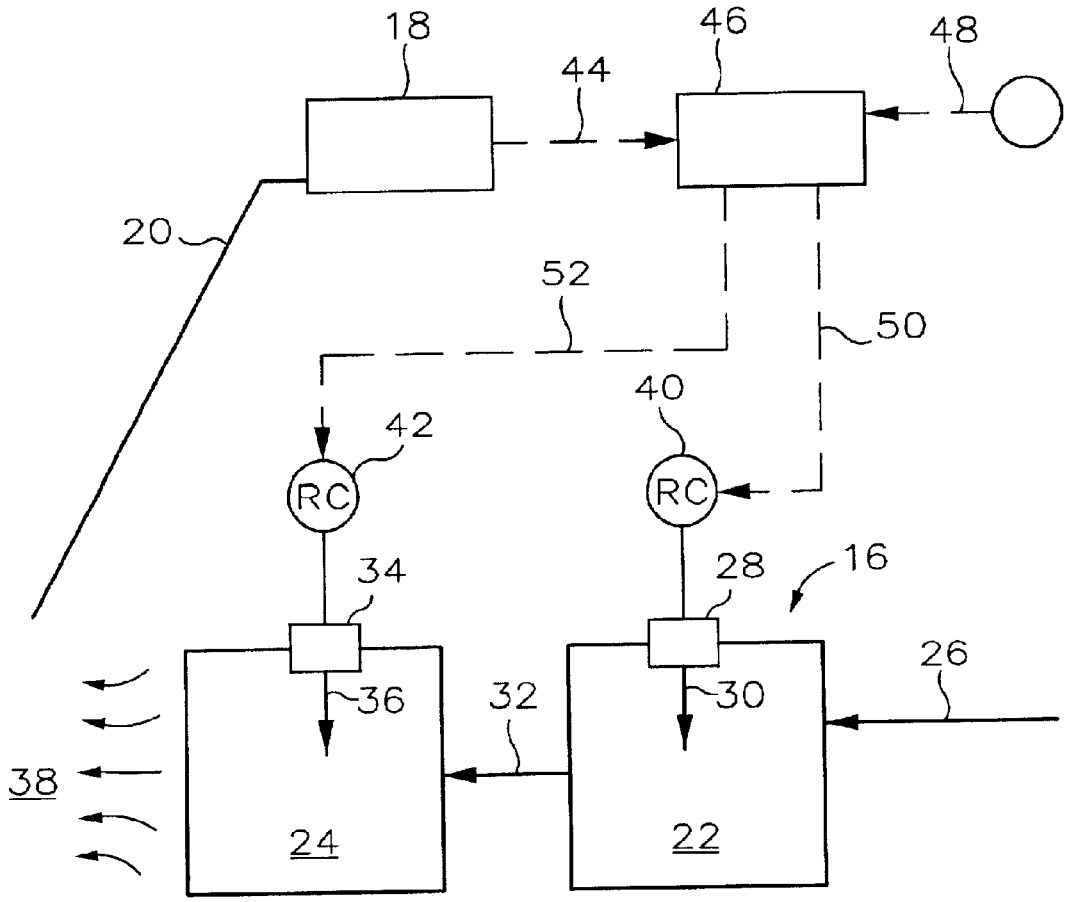
FIG. 2 is a schematic diagram showing in greater detail certain features of the combustion device shown in FIG. 1.

Referring to FIG. 2 for further description of the burner assemblies 16, each of the burner assemblies comprises a first mix chamber 22, a second mix chamber 24, a fuel introduction means 26 for introducing fuel to first mix chamber 22, an adjustable primary air register 28 providing primary air introduction means for introducing primary air 30 into first mix chamber 22. The primary air mixes with the fuel for combustion thereby producing an intermediate combustion product delivered to second mix chamber 24 via introduction means 32, which is connected in fluid flow communication with first mix chamber 22 and with second mix chamber 24. Burner assembly 16 also comprises an adjustable secondary air register 34 providing secondary air introduction means for introducing secondary air 36 into the second mix chamber 24 for mixture and further combustion with the intermediate combustion product thereby producing a combusted gas stream 38 for each burner assembly 16. The adjustable primary and secondary air registers, 28 and 34, respectively, are configured such that they can be opened or closed to allow more or less air to pass into burner assembly 16.

In addition, the inventive combustion device 10 can include a control system operably related to adjustable primary air register 28, adjustable secondary air register 34, and gas analyzer 18 which provides control means for adjusting the flow of primary air and the flow of secondary air to each of the burner assemblies 16 in each of the control zones 14 through adjustable primary air register 28 and adjustable secondary air register 34, respectively, in response to the value of a combustion characteristic measured in the collective combusted gas streams 38 corresponding to each of the control zones 14.

Dash lines, which designate signal lines in the drawings, are electrical or pneumatic in this preferred embodiment. However, the invention is also applicable to mechanical, hydraulic, or other signal means for transmitting information. In almost all control systems some combination of these types of signals will be used. However, the use of any other type of signal transmission, compatible with the process and equipment in use, is within the scope of the invention.

A digital computer is used in the preferred embodiment of this invention to calculate the required control signals based on measured process parameters as well as set points supplied to the computer. Any computer control system having software that allows operation in a real time environment for reading values of external variables and transmitting signals is suitable for use in this invention.

Signal lines are also utilized to represent the results of calculations carried out in a digital computer and the term "signal" is utilized to refer to such results. Thus, the term signal is used not only to refer to electrical currents or pneumatic pressures but is also used to refer to binary representations of a calculated or measured value.

The controllers shown may utilize the various modes of control such as proportional, proportional-integral, proportional-derivative, proportional-integral-derivative, or model predictive. In this preferred embodiment, proportional-integral-derivative controllers are utilized but any controller capable of accepting two input signals and producing a scaled output signal, representative of a comparison of the two input signals, is within the scope of the invention.

The scaling of an output signal by a controller is well known in control system art. Essentially, the output of a controller may be scaled to represent any desired factor or variable. An example of this is where a desired flow rate and an actual flow rate are compared by a controller. The output could be a signal representative of a desired change in the flow rate of some liquid necessary to make the desired and actual flows equal. On the other hand, the same output signal could be scaled to represent a percentage or could be scaled to represent a temperature change required to make the desired and actual flows equal, or could be scaled to represent the position of a mechanical device. If the controller output can range from 0 to 10 volts, which is typical, then the output signal could be scaled so that an output signal having a voltage level of 5.0 volts corresponds to 50 percent of some specified flow rate, or could be scaled so that an output signal having a voltage level of 5.0 volts corresponds to positioning a mechanical device to a 50% open position, such as an adjustable air register.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art.

Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter.

Regardless of the signal format or the exact relationship of the signal to the parameter which it represents, each signal representative of a measured process parameter or representative of a desired process value or representative of the position of a mechanical device will bear a relationship to the measured parameter or desired value or position which permits designation of a specific measured or desired value or position by a specific signal value. A signal which is representative of a process measurement or desired process value is therefore one from which the information regarding the measured or desired value can be readily retrieved regardless of the exact mathematical relationship between the signal units and the measured or desired process units.

Referring again to FIG. 2, the control system can be described as follows.

Adjustable primary air register 28 is operably related to a first register controller 40 for adjusting the register position. Adjustable secondary air register 34 is operably related to a second register controller 42 for adjusting the register position.

Gas analyzer 18 provides means for establishing a signal 44 representative of the actual value of a combustion characteristic of the combined combusted gas streams 38 measured by gas analyzer 18. Gas analyzer 18 is adapted to deliver, in response to the analysis of the combined combusted gas streams, signal 44.

A computer calculation block 46, providing computer means and preferably associated with a distributed control system, receives as inputs thereto combustion characteristic signal 44 and an operator entered signal 48 which is a set point representative of the desired value of the combustion characteristic.

Computer calculation block 46 establishes output signals 50 and 52, each responsive to the difference between signals 44 and 48. Signals 50 and 52 are scaled to be representative of the air register positions of the adjustable primary air register 28 and the adjustable secondary air register 34, respectively, required to maintain the actual value of the combustion characteristic represented by signal 44 substantially equal to the desired value of the combustion characteristic represented by signal 48.

Signal 50 is provided as a set-point to first register controller 40 for positioning of adjustable primary air register 28 accordingly.

Signal 52 is provided as a set point to second register controller 42 for positioning of adjustable secondary air register 34 accordingly.

The inventive combustion device 10 can be operated by:

a) providing the combustion device described above;

b) introducing fuel into each of the burner assemblies 16 in each of the control zones via the fuel introduction means 26;

c) introducing primary air into the first mix chamber 22 of the burner assemblies 16 in the control zones 14 via the primary air introduction means 28 for mixture and combustion with the fuel thereby producing an intermediate combustion product;

d) introducing secondary air into the second mix chamber 24 of the burner assemblies 16 in the control ones 14 via the secondary air introduction means 34 for mixture and further combustion with the intermediate combustion product delivered by introduction means 32 thereby producing a combusted gas stream 38 for each of the burner assemblies 16;

e) individually measuring the value of the combustion characteristic in the collective combusted gas streams 38 corresponding to each of the control zones 14; and f) adjusting the flow of primary air and the flow of secondary air to each of the burner assemblies 16 in each of the control zones 14 through the primary air introduction means 28 and the secondary air introduction means 34, respectively, in response to the value of the combustion characteristic measured in step e) corresponding to each of the control zones 14.

Preferably, the flow of primary air to each of the burner assemblies 16 in the plurality of control zones 14 is adjusted via the control means in response to the value of the combustion characteristic corresponding to each of the control zones 14 first, followed by adjustment of the flow of the secondary air, as needed, via the control means in order to keep the value of each combustion characteristic within a predetermined range.

The adjustment of the flow of primary air and the flow of secondary air to each of the burner assemblies 16 of step f) is performed such that the oxygen concentration in the collective combusted gas 38 for each of the control zones 14 is in the range of from about 0.5 to about 5.0 volume %, preferably from about 1.0 to about 3.0, and most preferably from 1.5 to 2.0, based on the total volume of the collective combusted gas, and/or such that carbon monoxide concentration in the collective combusted gas for each of the control zones 14 is preferably less than 1000 ppmv, more preferably less than about 500 ppmv, and most preferably substantially 0 ppmv, and/or such that carbon dioxide concentration in the collective combusted gas for each of the control zones 14 is preferably greater than about 2.0 volume %, more preferably greater than about 5.0 volume %, and most preferably greater than 10.0 volume %, based on the total volume of the collective combusted gas 38.

Figure 3:
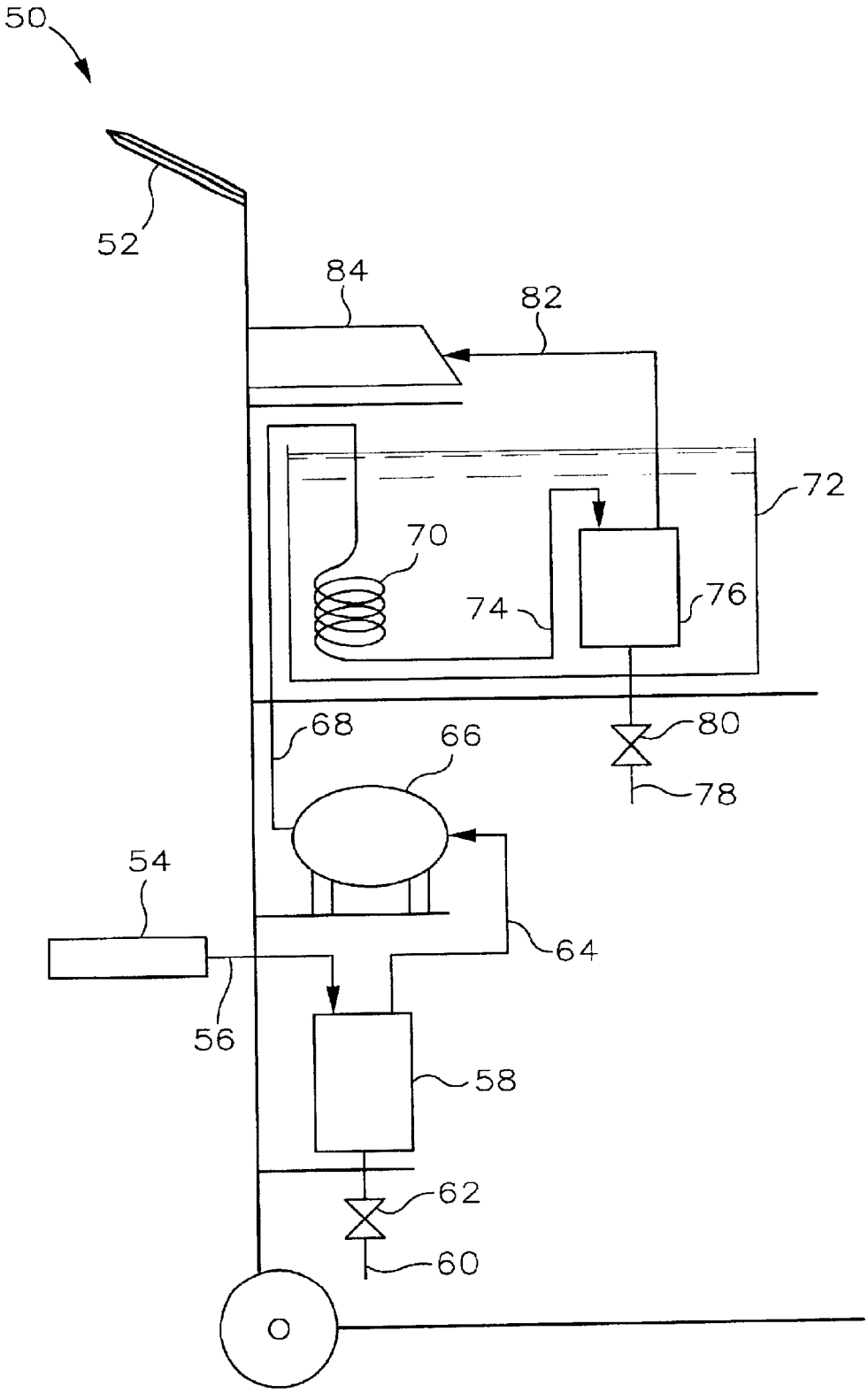
FIG. 3 is a schematic diagram of a combusted gas sampling cart constructed in accordance with the present invention.

Referring to FIG. 3, and in accordance with the invention, therein is illustrated an apparatus 50 suitable for analyzing combusted gas from a combustion device including a moveable cart 52 physically supporting the components described hereafter. A combusted gas probe 54, which can be water cooled, is connected in fluid flow communication via conduit 56 with a free water knock-out vessel 58, conduit 56 being suitable for delivering a combusted gas stream to free water knock-out vessel 58. Free water knock-out vessel 58 includes a conduit 60, having a valve 62 disposed therein, suitable for removing free water from free water knock-out vessel 58 which is separated from the combusted gas stream. Free water knock-out vessel 58 is also connected in fluid flow communication via conduit 64 with a vacuum pump 66 which provides motive force to the combusted gas stream. Vacuum pump 66 is connected in fluid flow communication via conduit 68 to a condenser 70 contained (submerged) in a cooler 72 for condensation of condensibles, such as water. The cooler 72 can be an ice bath.

Condenser 70 is connected in fluid flow communication via conduit 74 with a condensed water knock-out vessel 76 contained in cooler 72. Condensed water knock-out vessel 76 includes a conduit 78 having a valve 80 disposed therein suitable for removing condensed condensibles from condensed water knock-out vessel 76 which are separated from the combusted gas stream.

Condensed water knock-out vessel 76 is connected in fluid flow communication via conduit 82 with a combusted gas analyzer 84 wherein the combusted gas stream is analyzed for a combustion characteristic and the analysis results are displayed by paper printout or on a computer display terminal for operator use in adjusting primary and/or secondary air registers.

The inventive apparatus described above can be operated by:

a) supplying the apparatus described above; b) introducing a combusted gas stream from a combustion device to the free water knock-out vessel 58 via the combusted gas probe 54 and conduit 56; c) permitting free water in the combusted gas stream to separate from the combusted gas stream for removal from the free water knock-out vessel 58 via conduit 60; d) passing the combusted gas stream to the vacuum pump 66 via conduit 64; e) passing the combusted gas stream to the condenser 70 of the cooler 72 for condensation of at least a portion of the combusted gas stream thereby forming a liquid phase and a gas phase which are passed to the condensed water knock-out vessel 76 via conduit 74 for separation; and f) removing the liquid phase from the condensed water knock-out vessel 76 and passing the gas phase to the combusted gas analyzer 84 via conduit 82 for analysis.

EXAMPLE

The inventive method was tested on two commercial ethylene furnaces hereinafter referred to as Furnace A and Furnace B. These two furnaces produce ethylene, propylene, and other products by pyrolyzing a mixture of ethane and propane. They are large and consume vast quantities of fuel, so even small changes in their overall efficiency result in significant cost savings. The test consisted of three surveys of the two furnaces over the period of one calendar year. The first two surveys were primarily devoted to developing the measurement procedure and documenting the need for an improved burner adjustment method. The third survey was used to demonstrate the efficacy of the inventive adjustment method.

The burners of Furnace A and Furnace B are fueled by a mixture of hydrogen and methane with small amounts of other hydrocarbons. Air for combustion is supplied to each burner through two sets of air registers. The primary air registers provide air that is mixed with the fuel prior to combustion and the secondary registers provide air that is mixed with the fuel and primary air during and after combustion.

Proper adjustment of the burner air registers is vital in induced-draft furnaces such as Furnace A and Furnace B. Heat transfer to the pyrolysis tubes is highly dependent upon the size, shape, and intensity of the flames, all of which are directly affected by the amount of primary and secondary air that the burner receives. Since the furnaces are tall and contain many rows of burners, the vertical profile of the burners and their flames must also be considered and adjusted properly.

The standard method for adjusting the burner air registers to achieve optimum combustion conditions is based upon furnace draft and the appearance of the flames. The burner vendors taught maintenance personnel to adjust the burners on Furnace A and Furnace B in accordance with the standard method. The inventors believed the standard method to be flawed because draft is not necessarily linked to flame stoichiometry. Furthermore, the appearance of the typical high-hydrogen fuel flame gives no information about flame stoichiometry.

Survey and Testing Procedure

Combustion gas samples were collected using water-cooled steel probes which were inserted through peep doors into the furnaces. A piece of fabric insulation was used to seal around the probe and prevent air leaks into the furnaces through the peep doors during sampling. The sampled gases were analyzed in real-time using a Horiba MEXA-554J gas analyzer utilizing an electrolytic cell for $O_2$ measurement and non dispersive IR for CO and $CO_2$ measurement.

First Survey

Furnace A had been adjusted according to the vendor-recomnended procedure prior to the first survey and was believed to be running well. However, the inventors' measurements (Table 1) showed that CO was present throughout the radiant section, a sure indication that the burners were not receiving enough oxygen. Since stack CO remained low, it was evident that final burning was occurring in the convection section.

TABLE 1

First Survey - Furnace A

| Location | CO (ppmv) | $CO_2$ (vol. %) | $O_2$ (vol. %) | SR[2] |
|---|---|---|---|---|
| Convection Section | 0.0 | 10.0 | 1.0 | 1.05 |
| Radiant Section Level[1] | | | | |
| 4 | | Not Surveyed | | |
| 3 | 3.4 | 8.5 | 0.0 | 0.93 |
| 2 | | Not Surveyed | | |
| 1 | 1.5 | 9.6 | 0.0 | 0.97 |

[1]Furnace A has 4 radiant section levels.
[2]SR—Stoichiometric Ratio of Oxygen to fuel. A SR of 1.0 represents complete combustion.

Subsequent to the first survey, the operators opened the air registers on six of the furnaces in the plant, including Furnace A and Furnace B, to provide more air to the furnaces. Their adjustments succeeded in adding more fuel capacity to most, but not all, of the furnaces.

Second Survey

The second survey was conducted about three months after the first survey. By that time, the furnaces had again been adjusted according to the vendor-recommended procedure. The findings of the second survey are presented in Table 2. The concentration of oxygen ranged from 5.8% at the bottom to 2.2% in the convection section. The 2.2% oxygen concentration in the convection section would lead to similar stack oxygen concentrations from which operators would conclude that the furnace was running well. However, the high levels of oxygen lower in the furnace instead indicate that the furnace was in fact seriously unbalanced. While the overall amount of air entering the furnace was appropriate, the air was maldistributed. Too much air was entering at the lower burners and too little was entering at the higher burners. The excess air near the lower burners necessarily caused lower flame temperatures and reduced heat flux to the pyrolysis coils. The inventors also noted that the primary air registers on the lowest row of burners were completely closed, and consequently, believed the burners were operating diffusion flames rather than the preferred premixed flames. The surplus air from the lower part of the furnace rises to the upper rows of burners where it mixes with uncombusted fuel. The resulting diffusion flames are not very intense and therefore transfer heat to the pyrolysis coils poorly. Clearly, it is evident that Furnace A had been switched from the oxygen-deprived conditions observed during the first survey to oxygen-rich conditions but draft and flame appearance had again failed to optimize operations.

TABLE 2

Second Survey - Furnace A

| Location | CO (ppmv) | $CO_2$ (vol. %) | $O_2$ (vol. %) | SR[2] |
|---|---|---|---|---|
| Convection Section | 0.005 | 9.6 | 2.2 | 1.1 |
| Radiant Section Level[1] | | | | |
| 4 | | Not Surveyed | | |
| 3 | 0 | 9.6 | 3.0 | 1.2 |
| 2 | | Not Surveyed | | |
| 1 | 0 | 7.8 | 5.8 | 1.3 |

[1]Furnace A has 4 radiant section levels.
[2]SR—Stoichiometric Ratio of Oxygen to fuel. A SR of 1.0 represents complete combustion.

Third Survey

The inventive cart was designed and fashioned following the second survey to make moving from one location to another on the furnaces quicker and to speed the analysis. With the cart, a furnace could be sampled in less than an hour. Thus Furnace A and Furnace B were sampled multiple times during the third survey whereas three days had been required to sample Furnace A alone on the second survey. The manpower required to complete a survey was also reduced from three men to two with the cart.

The third survey was carried out about three months after the second survey and was for the purpose of bringing Furnaces A and B as close as possible to optimal performance. An initial sampling of Furnace A (see Table 3) confirmed that the conditions observed on the second survey, namely an excess of air on the bottom and a shortage of air near the top row of burners, still existed. The primary air registers on the bottom row of burners remained closed.

TABLE 3

| Third Survey - Furnace A-Initial | | | | |
|---|---|---|---|---|
| Location | CO (ppmv) | $CO_2$ (vol. %) | $O_2$ (vol. %) | SR[2] |
| Convection Section | | | | |
| Radiant Section Level[1] | | | | |
| 4 | | | | |
| 3 | | | | |
| 2 | 0 | 7.4 | 6.1 | 1.4 |
| 1 | 0 | 7.4 | 6.2 | 1.4 |

[1]Furnace A has 4 radiant section levels.
[2]SR—Stoichiometric Ratio of Oxygen to fuel. A SR of 1.0 represents complete combustion.

Adjustments began by opening the secondary registers on the two uppermost levels of burners of Furnace A. Then the primary registers on the bottom row of burners were opened. In-furnace measurement with the inventive cart indicated that these actions lowered the oxygen concentration at the lowest level of the furnace to 3.4%. Since less air then flowed into the lower part of the furnace, more air flowed elsewhere. This was reflected in the stack oxygen sensor, which showed that more oxygen was available. Consequently, the operator began to add more charge. As the charge increased, the automatic fuel flow controllers added more fuel, which consumed the additional oxygen. Additional probe measurements of oxygen and carbon monoxide concentration showed that the primary air registers on the bottom row of burners were providing insufficient air, so the secondary air registers were opened partially. The primary air registers at the top of the furnace were then opened. While these adjustments were occurring, the operator continued to add charge as the stack sensor showed additional oxygen available. A cycle of opening air registers, observing free oxygen, adding charge, and then waiting several hours for the furnace to equilibrate was established. The final probe measurements in Furnace A are presented in Table 4.

TABLE 4

| Final survey - Furnace A | | | |
|---|---|---|---|
| Location: | CO (ppmv) | CO2 (vol. %) | O2 (vol. %) |
| Radiant Section Level[1] | | | |
| 4 | .05 | 9.4 | 1.9 |
| 3 | 0 | 9.2 | 2.5 |
| 2 | 0 | 8.9 | 3.2 |
| 1 | N/a | N/a | N/a |

[1]Furnace A has 4 radiant section levels.
N/a—Not analyzed

The effect of the air register adjustments on the operation of Furnace A is summarized in Table 5. The key result is that the charge to the furnace increased by 11% while the fuel mass flow rate (not shown in Table 5) increased only by 9%. This means that the inventively adjusted furnace is processing more charge at a lower marginal cost as compared to the industry standard adjustment method. The production of steam, a by-product, increased in proportion to the charge. Also, the amount of oxygen in the stack decreased from 2.8% to 1.5%, indicating that the amount of air being drawn through the furnace is closer to the stoichiometric amount than before.

TABLE 5

| Impact of Inventive Adjustment Procedure on Furnace A Operation | | | |
|---|---|---|---|
| | Before | After | Change |
| Charge (lb/hr/coil) | 6500 | 7200 | 11% |
| Excess O2 (mole %) | 2.8 | 1.5 | |
| Steam Produced (klb/hr) | 107 | 118 | 11% |

Following the completion of work on Furnace A, a survey of Furnace B was performed. The results of that survey (see Table 6) indicate that Furnace B (adjusted per the industry standard method) operations were very similar to Furnace A, with relatively high oxygen concentrations throughout.

TABLE 6

| Initial Survey - Furnace B | | | |
|---|---|---|---|
| Location: | CO (ppmv) | CO2 (vol. %) | O2 (vol. %) |
| Radiant Section Level[1] | | | |
| 4 | .06 | 7.4 | 5.8 |
| 3 | 0.1 | 7.6 | 5.4 |
| 2 | 0 | 7.2 | 6.6 |
| 1 | 0 | 6 | 8.8 |

[1]Furnace B has 4 radiant section levels.

An register adjustment and charged increase procedure similar to that used on Furnace A was then followed. The final in-furnace measurements are presented in Table 7.

TABLE 7

| Final Survey - Furnace B | | | |
|---|---|---|---|
| Location: | CO (ppmv) | CO2 (vol. %) | O2 (vol. %) |
| Radiant Section Level[1] | | | |
| 4 | .04 | 8.2 | 3.6 |
| 3 | 0 | 8.0 | 4.8 |
| 2 | 0 | 7.4 | 5.6 |
| 1 | 0 | 7.3 | 6.1 |

[1]Furnace B has 4 radiant section levels.

Furnace operation results are presented in Table 8.

TABLE 8

| Impact of Inventive Adjustment Procedure on Furnace B Operation | | | |
|---|---|---|---|
| | Before | After | Change |
| Charge (lb/hr/coil) | 5900 | 6400 | 8% |
| Excess O2 (mole %) | 1.8 | 1.6 | |
| Steam Produced (klb/hr) | 82 | 90 | 9% |

The charge to Furnace B increased 8% while the fuel mass flow rate (not shown in Table 8) only increased 2%. Steam production increased and crossover temperature, an operating parameter, remained unchanged.

It should be noted that the oxygen readings were thought to be somewhat higher than actual during the survey of Furnace B due to the lack of a sealing gasket on the analyzer that was lost sometime during the day. Therefore, the reported oxygen data for Furnace B are less certain than for Furnace A, but the operation data provide strong evidence that similar results were obtained, and that the inventive adjustment procedure resulted in more efficient furnace operation as compared to the industry standard adjustment procedure.

The long-term sustainability of the increased charge rates could not be determined because the unit (including furnaces A and B) was forced to cut charge immediately after the surveying and adjusting were finished in order to process offtest ethylene from other units.

A portion of the fuel capacity increase observed during the third survey appears to be due to the fact that the adjustments resulted in more air being supplied to furnaces A and B. However, it is important to note that the air was redistributed as well. By increasing the proportions of primary air, which were particularly low in the furnace prior to implementation of the inventive method, it is believed that the burners' heat transfer efficiency was increased. Also, without the use of the inventive method, none of the adjustments would have been made because the furnaces were believed to be optimized based on furnace draft data and flame appearance.

Thus, the results described in the above example demonstrate that use of the inventive method and/or apparatus for operating a combustion device results in improved operation and efficiency as compared to combustion device operation without use of the inventive method and/or apparatus.

Whereas this invention has been described in terms of the preferred embodiments, reasonable variations and modifications are possible by those skilled in the art. Such modifications are within the scope of the described invention and appended claims.

That which is claimed is:

1. A method of optimizing the efficiency of a combustion device comprising at least three control zones, each of said control zones comprising at least one burner assembly, said method comprising:

a) individually supplying fuel to each of said burner assemblies in each of said control zones;

b) individually measuring a combustion characteristic of the collective combusted gas from said burner assemblies in each of said control zones, wherein said combustion characteristic is oxygen concentration; and c) individually adjusting the flow of air to each of said burner assemblies in each of said control zones in response to the value of said combustion characteristic corresponding to each of said control zones to keep the value of said combustion characteristic within a predetermined range, wherein said step of individually adjusting the flow of air to each of said burner assemblies in each of said control zones is performed such that the oxygen concentration in said collective combusted gas for each of said control zones is in the range of from about 0.5 to about 5.0 volume %, based on the total volume of said collective combusted gas.

2. A method in accordance with claim 1 wherein the step of individually adjusting the flow of air to each of said burner assemblies in each of said control zones of step c) is performed such that the oxygen concentration in said collective combusted gas for each of said control zones is in the range of from about 1.0 to about 3.0 volume %, based on the total volume of said collective combusted gas.

3. A method in accordance with claim 1 wherein the step of individually adjusting the flow of air to each of said burner assemblies in each of said control zones of step c) is performed such that the oxygen concentration in said collective combusted gas for each of said control zones is in the range of from 1.5 to 2.0 volume %, based on the total volume of said collective combusted gas.

4. A method of optimizing the efficiency of a combustion device comprising at least three control zones, each of said control zones comprising at least one burner assembly, said method comprising:

a) individually supplying fuel to each of said burner assemblies in each of said control zones;

b) individually measuring a combustion characteristic of the collective combusted gas from said burner assemblies in each of said control zones, wherein said combustion characteristic is carbon dioxide concentration; and c) individually adjusting the flow of air to each of said burner assemblies in each of said control zones in response to the value of said combustion characteristic corresponding to each of said control zones to keep the value of each of said combustion characteristic within a predetermined range, wherein said step of individually adjusting the flow of air to each of said burner assemblies in each of said control zones is performed such that the carbon dioxide concentration in said collective combusted gas for each of said control zones is greater than about 2.0 volume %, based on the total volume of said collective combusted gas.

5. A method in accordance with claim 4 wherein the step of individually adjusting the flow of air to each of said burner assemblies in each of said control zones of step c) is performed such that the carbon dioxide concentration in said collective combusted gas for each of said control zones is greater than about 5.0 volume %, based on the total volume of said collective combusted gas.

6. A method in accordance with claim 4 wherein the step of individually adjusting the flow of air to each of said burner assemblies in each of said control zones of step c) is performed such that the carbon dioxide concentration in said collective combusted gas for each of said control zones is greater than about 10.0 volume %, based on the total volume of said collective combusted gas.

7. A method of optimizing the efficiency of a combustion device comprising at least three control zones, each of said control zones comprising at least one burner assembly, said method comprising:

a) individually supplying fuel to each of said burner assemblies in each of said control zones;

b) individually measuring a combustion characteristic of the collective combusted gas from said burner assemblies in each of said control zones, wherein said combustion characteristic is carbon monoxide concentration; and c) individually adjusting the flow of air to each of said burner assemblies in each of said control zones in response to the value of said combustion characteristic corresponding to each of said control zones to keep the value of each of said combustion characteristic within a predetermined range, wherein the step of individually adjusting the flow of air to each of said burner assemblies in each of said control zones is performed such that the carbon monoxide concentration in said collective combusted gas for each of said control zones is less than about 1000 ppmv, based on the total volume of said collective combusted gas.

8. A method in accordance with claim 7 wherein the step of individually adjusting the flow of air to each of said burner assemblies in each of said control zones of step c) is performed such that the carbon monoxide concentration in said collective combusted gas for each of said control zones is less than about 500 ppmv, based on the total volume of said collective combusted gas.

9. A method in accordance with claim 7 wherein the step of individually adjusting the flow of air to each of said burner assemblies in each of said control zones of step c) is performed such that the carbon monoxide concentration in said collective combusted gas for each of said control zones is substantially 0 ppmv, based on the total volume of said collective combusted gas.

10. A method of optimizing the efficiency of a combustion device comprising at least three control zones, each of said control zones comprising at least one burner assembly, said method comprising:

a) individually supplying fuel to each of said burner assemblies in each of said control zones;

b) individually supplying primary air to each of said burner assemblies in each of said control zones for mixture and at least partial combustion with said fuel supplied thereto thereby producing a separate intermediate combustion product for each of said burner assemblies;

c) individually supplying secondary air to each of said burner assemblies and each of said control zones for mixture with said intermediate combustion product for further combustion thereby producing a combusted gas stream for each of said burner assemblies;

d) individually measuring a combustion characteristic of the collective combusted gas from said burner assemblies in each of said control zones, wherein said combustion characteristic is oxygen concentration; and e) individually adjusting the flow of said primary air and individually adjusting the flow of said secondary air to each of said burner assemblies in each of said control zones in response to the value of said combustion characteristic corresponding to each of said control zones to keep the value of each of said combustion characteristics within a predetermined range, wherein the flow of said primary air to each of said burner assemblies is adjusted in response to the value of said combustion characteristic corresponding to each of said control zones first, followed by adjustment of the flow of said secondary air, as needed, in order to keep the value of said combustion characteristic within said predetermined range, and wherein said step of individually adjusting the flow of said primary air and individually adjusting the flow of said secondary air to each of said burner assemblies is performed such that the oxygen concentration in said collective combusted gas corresponding to each of said control zones is in the range of from about 0.5 to about 5.0 volume %, based on the total volume of said collective combusted gas.

11. A method in accordance with claim 10 wherein the step of individually adjusting the flow of said primary air and of individually adjusting the flow of said secondary air to each of said burner assemblies of step e) is performed such that the oxygen concentration of said collective combusted gas corresponding to each of said control zones is in the range of from about 1.0 to about 3.0 volume %, based on the total volume of said collective combusted gas.

12. A method in accordance with claim 10 wherein the step of individually adjusting the flow of said primary air and of individually adjusting the flow of said secondary air to each of said burner assemblies of step e) is performed such that the oxygen concentration of said collective combusted gas corresponding to each of said control zones is in the range of from 1.5 to 2.0 volume %, based on the total volume of said collective combusted gas.

13. A method of optimizing the efficiency of a combustion device comprising at least three control zones, each of said control zones comprising at least one burner assembly, said method comprising:

a) individually supplying fuel to each of said burner assemblies in each of said control zones;

b) individually supplying primary air to each of said burner assemblies in each of said control zones for mixture and at least partial combustion with said fuel supplied thereto thereby producing a separate intermediate combustion product for each of said burner assemblies;

c) individually supplying secondary air to each of said burner assemblies in each of said control zones for mixture with said intermediate combustion product for further combustion thereby producing a combusted gas stream for each of said burner assemblies;

d) individually measuring a combustion characteristic of the collective combusted gas from said burner assemblies in each of said control zones wherein said combustion characteristic is carbon dioxide concentration; and e) individually adjusting the flow of said primary air and individually adjusting the flow of said secondary air to each of said burner assemblies in each of said control zones in response to the value of said combustion characteristic corresponding to each of said control zones to keep the value of each of said combustion characteristics within a predetermined range, wherein the flow of said primary air to each of said burner assemblies in each of said control zones is adjusted in response to the value of said combustion characteristic corresponding to each of said control zones first, followed by adjustment of the flow of said secondary air, as needed, in order to keep the value of each of said combustion characteristics within said predetermined range, and wherein said step of individually adjusting the flow of said primary air and individually adjusting the flow of said secondary air to each of said burner assemblies is performed such that the carbon dioxide concentration in said collective combusted gas corresponding to each of said control zones is greater than 2.0 volume %, based on the total volume of said collective combusted gas.

14. A method in accordance with claims 13 wherein the step of individually adjusting the flow of said primary air and of individually adjusting the flow of said secondary air to each of said burner assemblies of step e) is performed such that the carbon dioxide concentration of said collective combusted gas corresponding to each of said control zones is greater than about 5.0 volume %, based on the total volume of said collective combusted gas.

15. A method in accordance with claim 13 wherein the step of individually adjusting the flow of said primary air and of individually adjusting the flow of said secondary air to each of said burner assemblies of step e) is performed such that the carbon dioxide concentration of said collective combusted gas corresponding to each of said control zones is greater than 10.0 volume %, based on the total volume of said collective combusted gas.

16. A method of optimizing the efficiency of a combustion device comprising at least three control zones, each of said control zones comprising at least one burner assembly, said method comprising:

a) individually supplying fuel to each of said burner assemblies in each of said control zones;

b) individually supplying primary air to each of said burner assemblies in each of said control zones for mixture and at least partial combustion with said fuel supplied thereto, thereby producing a separate intermediate combustion product for each of said burner assemblies;

c) individually supplying secondary air to each of said burner assemblies in each of said control zones for mixture with said intermediate combustion product for further combustion thereby producing a combusted gas stream for each of said burner assemblies;

d) individually measuring a combustion characteristic of the collective combusted gas from said burner assemblies in each of said control zones, wherein said combustion characteristic is carbon monoxide concentration; and e) individually adjusting the flow of said primary air and individually adjusting the flow of said secondary air to each of said burner assemblies in each of said control zones in response to the value of said combustion characteristic corresponding to each of said control zones to keep the value of each of said combustion characteristics within a predetermined range, wherein the flow of said primary air to each of said burner assemblies is adjusted in response to the value of said combustion characteristic corresponding to each of said control zones first, followed by adjustment of the flow of said secondary air, as needed, in order to keep the value of each of said combustion characteristics within said predetermined range, and wherein said step of individually adjusting the flow of said primary air and of individually adjusting the flow of said secondary air to each of said burner assemblies is performed such that the carbon monoxide concentration of said collective combusted gas corresponding to each of said control zones is less than about 1000 ppmv, based on the total volume of said collective combusted gas.

17. A method in accordance with claim 16 wherein the step of individually adjusting the flow of said primary air and of individually adjusting the flow of said secondary air to each of said burner assemblies of step e) is performed such that the carbon monoxide concentration of said collective combusted gas corresponding to each of said control zones is less than about 500 ppmv, based on the total volume of said collective combusted gas.

18. A method in accordance with claim 16 wherein the step of individually adjusting the flow of said primary air and of individually adjusting the flow of said secondary air to each of said burner assemblies of step e) is performed such that said carbon monoxide concentration of said collective combusted gas corresponding to each of said control zones is substantially 0 ppmv, based on the total volume of said collective combusted gas.

19. A method of increasing the efficiency of a combustion device comprising the following steps:

a) providing a combustion device comprising:

i) at least three control zones, each of said control zones comprising at least one burner assembly;

ii) at least one gas analyzer operably related to each of said control zones for receiving and analyzing samples of combusted gas from each of said control zones;

iii) each of said burner assemblies comprising:

a) a fuel introduction means for introducing fuel into said burner assembly;

b) a primary air introduction means for introducing primary air into said burner assembly for mixture and at least partial combustion with said fuel, thereby producing an intermediate combustion product; and c) a secondary air introduction means for introducing secondary air into said burner assembly for mixture and further combustion with said intermediate combustion product, thereby producing a combusted gas stream for each of said burner assemblies; and iv) control means operably related to said primary air introduction means, said secondary air introduction means, and said at least one gas analyzer, for adjusting the flow of primary air and the flow of secondary air to each of said burner assemblies in each of said control zones through said primary air introduction means and said secondary air introduction means, respectively, in response to the value of a combustion characteristic measured in the collective combusted gas streams corresponding to each of said control zones;

b) introducing fuel into each of said burner assemblies in each of said control zones via said fuel introduction means;

c) introducing primary air into said burner assemblies in each of said control zones via said primary air introduction means for mixture and at least partial combustion with said fuel thereby producing an intermediate combustion product;

d) introducing secondary air into said burner assemblies in each of said control zones via said secondary air introduction means for mixture and further combustion with said intermediate combustion product thereby producing a combusted gas stream for each of said burner assemblies;

e) individually measuring the value of a combustion characteristic in the collective combusted gas streams corresponding to each of said control zones wherein said combustion characteristic is selected from the group consisting of oxygen concentration, carbon dioxide concentration, and carbon monoxide concentration;

f) adjusting the flow of said primary air and the flow of said secondary air to each of said burner assemblies in each of said control zones through said primary air introduction means and said secondary air introduction means, respectively, in response to the value of said combustion characteristics measured in step e) corresponding to each of said control zones wherein the flow of said primary air to each of said burner assemblies in each of said control zones is adjusted via said control means in response to the value of said combustion characteristic corresponding to each of said control zones first, followed by adjustment of the flow of said secondary air, as needed, via said control means in order to keep the value of each of said combustion characteristics within a predetermined range, wherein the step of adjusting the flow of said primary air and the flow of said secondary air to each of said burner assemblies is performed such that the oxygen concentration in the collective combusted gas for each of said control zones is in the range of from about 0.5 to about 5.0 volume %, based on the total volume of said collective combusted gas, and such that the carbon dioxide concentration in the collective combusted gas for each of said control zones is greater than about 2.0 volume %, based on the total volume of said collective combusted gas, and such that that the carbon monoxide concentration in the collective combusted gas for each of said control zones is less than about 1000 ppmv, based on the total volume of said collective combusted gas.

20. A method in accordance with claim 19 wherein the step of adjusting the flow of said primary air and the flow of said secondary air to each of said burner assemblies of step f) is performed such that the oxygen concentration in the collective combusted gas for each of said control zones is in the range of from about 1.0 to about 3.0 volume %, based on the total volume of said collective combusted gas.

21. A method in accordance with claims 19 wherein the step of adjusting the flow of said primary air and the flow of said secondary air to each of said burner assemblies of step f) is performed such that the oxygen concentration in the collective combusted gas for each of said control zones is in the range of from 1.5 to 2.0 volume %, based on the total volume of said collective combusted gas.

22. A method in accordance with claims 19 wherein the step of adjusting the flow of said primary air and the flow of said secondary air to each of said burner assemblies of step f) is performed such that the carbon dioxide concentration in the collective combusted gas for each of said control zones is greater than about 5.0 volume %, based on the total volume of said collective combusted gas.

23. A method in accordance with claim 19 wherein the step of adjusting the flow of said primary air and the flow of said secondary air to each of said burner assemblies of step f) is performed such that the carbon dioxide concentration in the collective combusted gas for each of said control zones is greater than 10.0 volume %, based on the total volume of said collective combusted gas.

24. A method in accordance with claims 19 wherein the step of adjusting the flow of said primary air and the flow of said secondary air to each of said burner assemblies of step f) is performed such that the carbon monoxide concentration in the collective combusted gas for each of said control zones is less than about 500 ppmv, based on the total volume of said collective combusted gas.

25. A method in accordance with claim 19 wherein the step of adjusting the flow of said primary air and the flow of said secondary air to each of said burner assemblies of step f) is performed such that the carbon monoxide concentration in the collective combusted gas for each of said control zones is substantially 0 ppmv, based on the total volume of said collective combusted gas.

* * * * *